United States Patent [19]

Monson

[11] 4,441,229

[45] Apr. 10, 1984

[54] ROTARY CLEANER-POLISHER

[76] Inventor: Clifford L. Monson, #280 1765 Ala Moana Blvd., Honolulu, Hi. 96815

[21] Appl. No.: 387,705

[22] Filed: Jun. 11, 1982

Related U.S. Application Data

[63] Continuation-in-part of Ser. No. 251,118, Apr. 6, 1981, Pat. No. 4,339,840.

[51] Int. Cl.[3] ..... A47L 11/30; A47L 11/292

[52] U.S. Cl. ..... 15/322; 15/320; 15/359; 15/385

[58] Field of Search ..... 15/320, 321, 322, 385, 15/359

[56] References Cited

U.S. PATENT DOCUMENTS

| | | | |
|---|---|---|---|
| 3,619,848 | 11/1971 | Salzmann | 15/320 |
| 3,624,668 | 11/1971 | Krause | 15/321 X |
| 4,000,538 | 1/1977 | Tissier | 15/320 |
| 4,182,001 | 1/1980 | Krause | 15/320 |
| 4,264,999 | 5/1981 | Monson | 15/321 |

*Primary Examiner*—Chris K. Moore

*Attorney, Agent, or Firm*—Cole, Jensen & Puntigam

[57] ABSTRACT

A rotary flooring cleaner-polisher wherein a shroud overlies a plurality of floor contacting rotating wands. The operator is able to selectively supply fluid, a vacuum or both to the area beneath the shroud permitting both application and extraction within the defined area via a hollow central drive shaft. At least one of the rotating wands which are flexibly mounted to the drive shaft includes an elongated slot along its lower surface in communication with the vacuum source such that the extaction is done through the wand and then through the drive shaft. The solution to be applied to the flooring surface may be sprayed in a general pattern beneath the shroud or in a controlled manner through the interior of one or more of the wands.

3 Claims, 6 Drawing Figures

ROTARY CLEANER-POLISHER

This application is a continuation-in-part of U.S. application Ser. No. 251,188 filed Apr. 6, 1981, now U.S. Pat. No. 4,339,840, issued July 20, 1982, and incorporates that disclosure by reference.

DESCRIPTION

1. Technical Field

This invention relates generally to the art of floor cleaning and polishing machines, and more particularly concerns a cleaning and polishing machine which has a removable scrubbing head which is contained within a shroud enabling precise monitoring of the relationship of the liquid applied and the vacuum removal.

2. Background Art

The utilization of mechanisms to assist the cleaning and polishing of hard floors and the cleaning, vacuuming and dying of soft floors such as carpeting are well known in the art. Most people in our technologically advanced society are familiar with a motor driven brush or plurality of brushes utilized on a hard surface for scrubbing and/or removing wax. Most people are also familiar with the rotary scrubbers for applying and agitating cleaning solutions for cleaning carpeting or similar materials. Professional carpet cleaners utilize a more powerful method of cleaning carpets including an injection of fluid including solvents and hot water or steam with a single wand which likewise is used to extract the dirty solution after agitation into the fibers.

Prior art which exemplifies the above noted knowledge include U.S. Pat. No. 3,375,540 granted to Hyde, Apr. 2, 1968, which discloses a floor cleaning machine having a rotatable center pad and a peripheral, flexible vacuum skirt as an attachment thereto.

U.S. Pat. No. 3,619,848 granted to Salzmann, Nov. 16, 1971 discloses a rotary appliance for cleaning floors including a means for applying liquid to the area beneath a rotating brush and means for recovering the fluid upwardly through the center of the drive mechanism.

U.S. Pat. No. 3,624,668 granted to Krause on Nov. 30, 1971 discloses a surface cleaning device including a rotating lower unit having a donut-shaped tool which includes a plurality of vacuum openings and an attached spray nozzle. The vacuum openings in this tool interconnect with an annular vacuum collecting chamber which is in fluid communication with an extracting conduit.

U.S. Pat. No. 4,000,583 granted to Tissier on Jan. 4, 1977, discloses a cleaning device for floor surfaces wherein the dirty water from the floor, generated by scrub brushes, is evacuated by a peripheral gutter-type arrangement and then transferred by a conduit to a central hub and then outwardly to an appropriate storage or disposal location.

U.S. Pat. No. 4,182,001, granted to Krause on Jan. 8, 1980, discloses a surface cleaning and rinsing device having a plurality of brushes which are rotated in a direction opposite to and a speed different from the rotor. The device further includes a plurality of suction nozzles spaced between the brushes which rotate at the same speed as the hub or rotor, and thus at a lesser speed than the individual brushes but immediately follows them around the floor surface.

With the above noted prior art in mind, it is an object of the present invention to provide a rotary floor scrubber/polisher which is simple of construction, efficient in use, and one which does a far more complete job than heretofore possible.

It is another object of the present invention to provide a rotary scrub-type device which includes a rotary head which is readily detachable from the main unit, enabling rapid and easy replacement in the event of damage.

Another further object of the invention is to provide a rotary floor cleaning machine wherein the soiled material is extracted upwardly through the hub of the machine and the cleaning solution may be simultaneously fed downwardly through the hub of the machine.

It is still a further object of the present invention to provide a plurality of cleaning tools which are in constant contact with the floor and are mounted upon flexible individual arms such as they may absorb and accommodate minor variations in the flooring surface.

It is yet another object of the present invention to provide a very well-defined and enclosed spray, thus closely regulating both the location of the spray and the amount of fluid placed on the flooring material, in relationship to the extraction.

DISCLOSURE OF THE INVENTION

Accordingly, the present invention is a floor scrubbing/polishing machine which includes a floor scrubbing head which is easily replaceable, has the fluid applied and the waste removed through a hollow vertical drive shaft and further, includes the ability to carefully and precisely monitor the relationship of the cleaning or dying fluid applied with relationship to the vacuum removal. The fluid may be applied through a central spray nozzle or in the alternative may be sprayed within one or more of a plurality of scrubbing wands such that the fluid applied is specifically located.

BEST MODE FOR CARRYING OUT THE INVENTION

Figure 1:
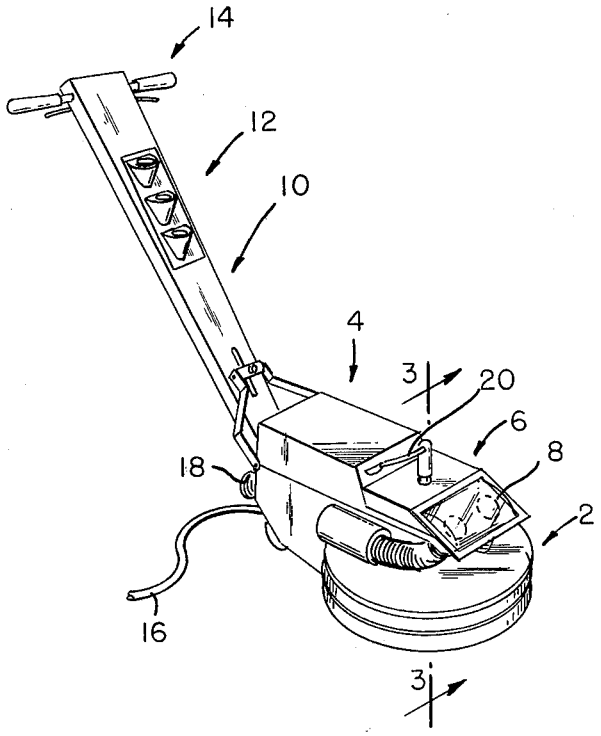
FIG. 1 discloses a perspective environmental view of the inventive cleaning machine.

As seen in FIG. 1, the inventive rotary floor scrubbing machine includes a scrubber portion generally designated as 2 upon which is mounted a drive motor 4, a gear box 6, a view chamber 8, all of which are secured to handle means 10. The necessary gauges 12 and hand grips 14 may be seen. The power for the motor is provided by means of an electrical concuit 16 and the vacuum source is supplied via conduit 18. The cleaning solution is drawn from a central supply through conduit 20, and as explained hereinafter, forced downwardly through the hub of the machine to the scrubber wands enclosed within a shroud 54.

Figure 2:
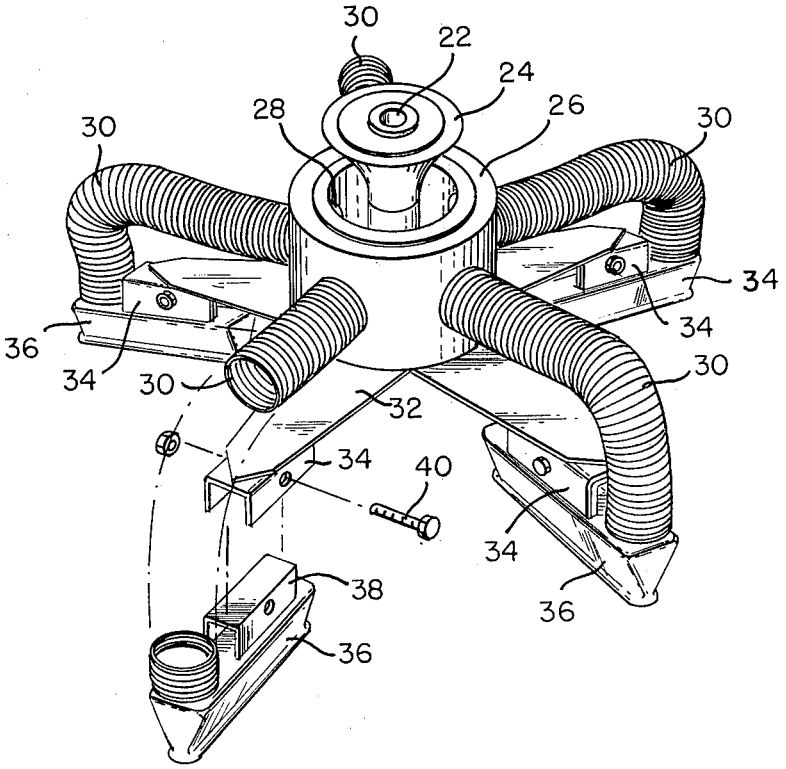
FIG. 2 is an enlarged perspective view of the removable head, including the individual cleaning wands.

Referring now to FIG. 2, the details of the scrubber head may be seen. The scrubber head is secured to the machine by means of a threaded interconnection 22 which, as explained in detail hereinafter, allows the scrubber heat to easily be removed and replaced. The threaded interconnection is to the hollow drive shaft 5 as explained hereinafter.

Figure 3:
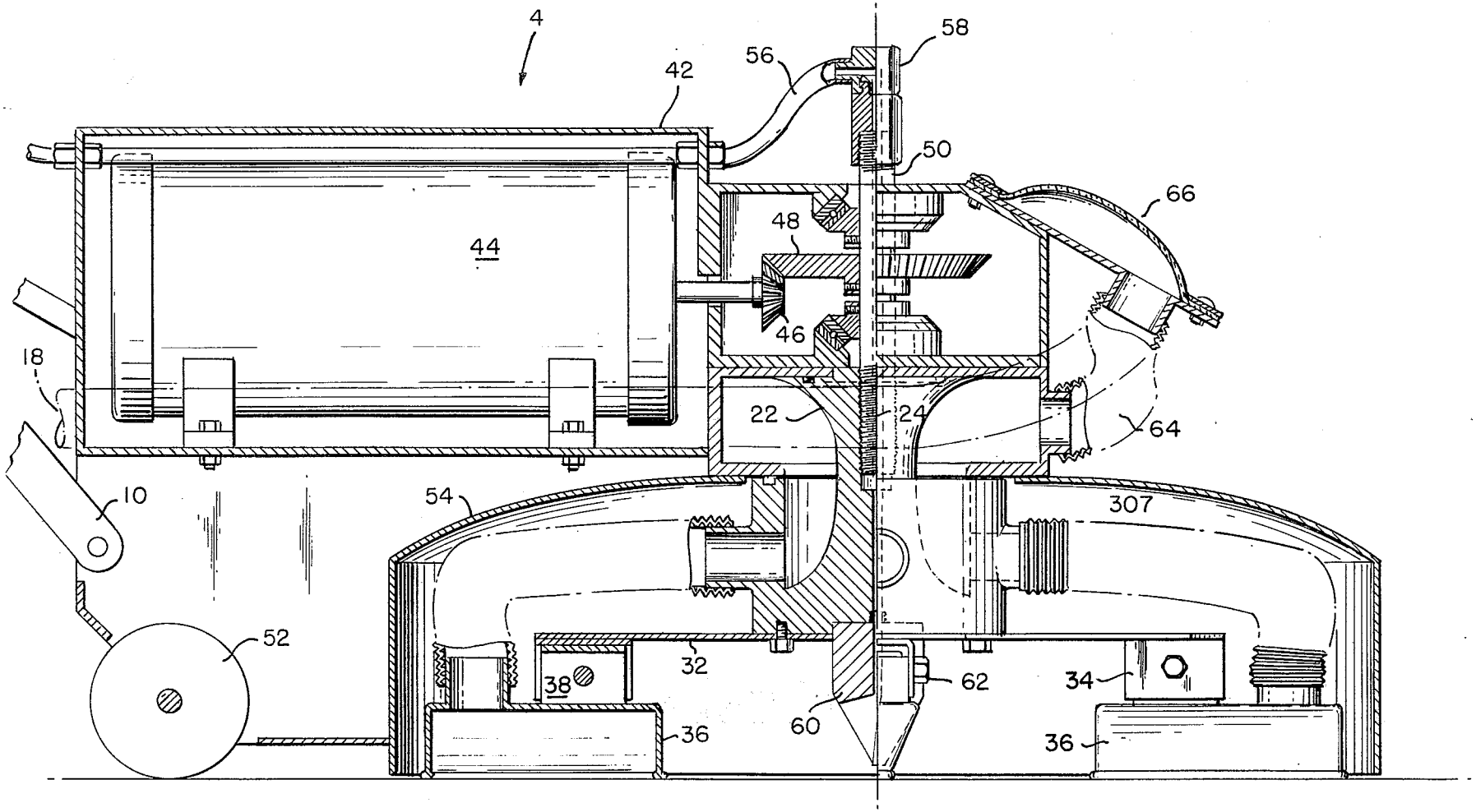
FIG. 3 is a sectional view of the lower portion of the machine as seen along lines 3—3 of FIG. 1.

Secured to the upper portion of hollow central drive shaft 22 is a deflector 24 which as best seen in FIG. 3, is in the shape of a cylinder necked down at the center to control the direction and flow of returning dirty fluid. The fluid enters at the bottom of the chamber and is deflected and sprayed outwardly as it moves upwardly through the chamber. Secured to the central drive shaft 22 is a hub member 26 which surrounds deflector 24. Hub member 26 has a plurality of openings 28 to which are secured a plurality of flexible conduits 30 interconnected to the wands as explained hereinafter to allow the return of the dirty fluid.

The plurality of radially extending flexible arm members 32 secured to hub 26 have secured to the outer ends thereof bracket members 34 to which are pivotally mounted wand elements 36. Each of the wand elements 36 are secured to brackets 34 by means of an upwardly extending complimentary bracket member 38 and pin member 40 in the form of an adjustable bolt thereby enabling the friction between the two members and thus the relative movement to be controlled.

Referring now to FIG. 3, it can be seen that the motor element, generally designated as 4, actually includes a case element 42 which covers an electric motor or other primary drive element 44 including a bevel gear 46 mounted to the output shaft. Bevel gear 46 meshes with bevel gear 48, of an appropriate force and speed multiplication, mounted in the horizontal position and keyed to the vertical hollow drive shaft 50 to which the threaded fluid disseminating element 22 is interconnected. Threaded element 22 is integral with the hour glass shaped portion 24 and hub 26. As is further seen in this view, the flexible conduits 30 which interconnect with the wand members 36 are secured to bracket 38 which is pivotally connected to arm 32.

Further to be seen in this view are wheels 62 for ease of movement of the entire device from location to location and the interconnection of the handle means 10. It is to be reiterated that the entire wand assembly is contained and shielded by a shroud means 54 which extends from the bottom of the main housing to a point immediately adjacent to the flooring surface to be scrubbed.

A small conduit 56, carrying the cleaning or dying fluid, passes within the housing 42 which covers the motor and then interconnects with a fluid-tight interconnecting element 58 which permits fluid from conduit 56 to pass down through the interior of the hollow drive shaft 50. Mounted to the bottom of hollow drive shaft 50 is a spray assemblage 60 having nozzle elements 62.

In operation the cleaning or dying fluid will be supplied via conduit 56 and hollow drive shaft 50 to be applied on the floor surface through nozzle 62. The drive shaft will be rotating such that the cleaning fluid will be uniformly sprayed throughout the entire floor area within the shroud. Wand elements 36, which are likewise interconnected with the rotating hollow drive shaft driven by motor 44, rotate causing the lips or lower surface of the element 36 to scrub the flooring surface, bending the rug fibers over and reaching the base thereof. Simultaneously with the rotary scrubbing action, a negative pressure is applied to the area within the wands via conduits 18, 30 and transmitted via the hollow hub member 26. The cleaning fluid and dirt contained therein is thus carried upwardly through conduits 30 into the hollow hub and outwardly via conduit 64 through a display or visibility chamber 66 where the operator can determine the color and condition of the returning fluid and thus to final evacuation via conduit 18.

It should be understood that although the preferred embodiment is described with respect to a machine operable because of remote supply of negative pressure and cleaning fluid, it is contemplated that with minor modification these necessary forces could likewise be a portion of the finished apparatus making it a self-contained unit.

Figure 4:
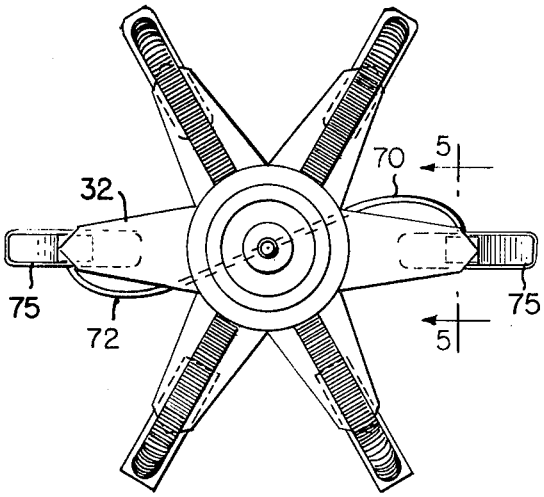
FIG. 4 is a bottom plan view of an alternative embodiement of the structure shown in FIG. 3.
Figure 5:
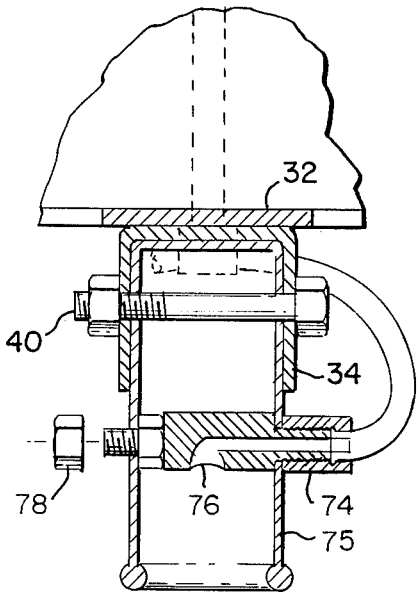
FIG. 5 is a vertical sectional view taken along lines 5—5 of FIG. 4.
Figure 6:
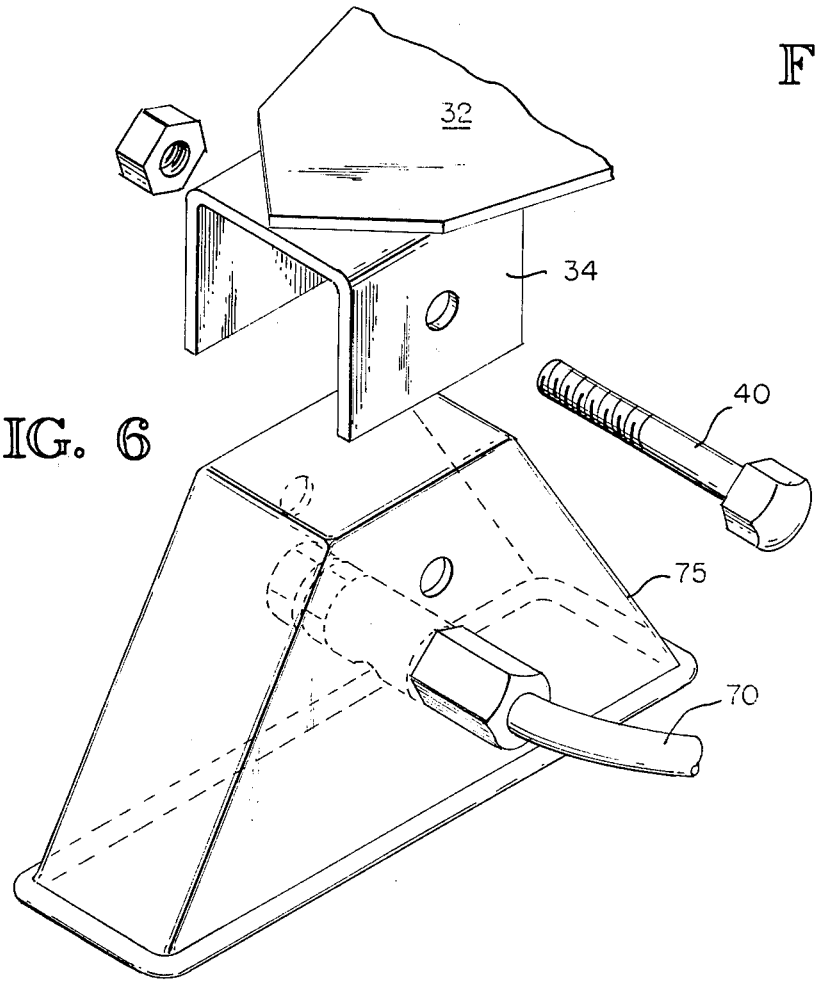
FIG. 6 is an exploded view of the spray nozzle and container as seen in FIG. 5.

Referring now to the FIGS. 4, 5 and 6, another embodiment of the invention can be seen. In this particular embodiment, the cleaning head consists of a central hub much as described hereinabove to which are mounted six flexible wands. In this embodiment, four of the wands are substantially as described hereinabove and serve as a source for the negative pressure to draw the dirty cleaning solution from the flooring surface. The remaining two wands, which are diametrically opposed, are connected via conduits 70, 72 and provide the source of the cleaning solution.

Referring now to FIG. 5, it can be seen that the conduit 70 is sealingly interconnected with a nozzle member 74 and a flood type nozzle 76 removably mounted within the interior of the hollow wand 36. The nozzle is secured in position by means of a threaded nut 78.

The interrelationship of the device may be more readily seen in FIG. 6 where the outwardly extending flexible arm member 32 is secured to bracket 34 through which the pivot pin 40 is passed thus pivotally holding the wand element 75 in place. Further, to be seen is the flood nozzle connected to conduit 70 within the wand member 75.

In operation, the cleaning fluid, or alternatively the dying fluid is sprayed out a small confined area, agitated and then removed by the following wands. The amount of fluid, the amount of agitation and the duration of fluid contact may be easily controlled.

I claim:

1. A rotatable cleaning head for use in a carpet cleaner or the like comprising:

a hub member including a quick release means for securement to a hollow drive shaft including means for conducting a negative pressure air flow and a means for conducting fluid under positive pressure;

a plurality of radially outwardly extending resilient arms secured to the hub member and rotatable therewith;

vacuum head means pivotably secured to each resilient arm member, said vacuum head means including a lower surface designed to be in contact with the surface to be cleaned and including a radially extending slot in fluid communication with the negative pressure airflow conducting means;

nozzle means in communication with the positive fluid flow conducting means whereby fluid may be sprayed upon the surface to be treated, and the vacuum head means, always in total surface contact, agitate the surface and extract the fluid.

2. A cleaning head for use in a carpet cleaning device or the like comprising:

a hollow hub member adapted to be in communication with a vacuum source said hub member removably secured to a hollow vertical drive shaft;

a plurality of radially extending resilient arm members secured to and rotatable with the hub member;

a cleaning head pivotably secured to the outer end of as least a purality of the arm members, each said cleaning head being substantially hollow and including a downwardly facing opening including carpet contacting lips and an exit port in fluid communication with the hub member whereby the lips remain in contact with the carpet regardless of slight changes in the orientation of the hub member.

3. A scrubbing device primarily for use with carpeting comprising:

a downwardly open shroud means including an opening in the upper portion thereof;

hollow vertical driveshaft means extending from a drive means mounted above the shroud means to selectively rotatable cleaning means beneath the shroud means, said cleaning means comprising a plurality of radially extending resilient arms secured to the hollow vertical driveshaft means and a plurality of pivotably mounted cleaning heads having downwardly facing openings to contact the surface providing the sole support for the scrubbing device, and exit openings in fluid communication with a vacuum source, whereby the device may be moved over the surface, the heads constantly agitate the surface, and foreign material be extracted through the openings.

* * * * *